United States Patent [19]

Kita et al.

[11] Patent Number: 5,071,737

[45] Date of Patent: Dec. 10, 1991

[54] SILVER HALIDE PHOTOGRAPHIC MATERIAL

[75] Inventors: Hiroshi Kita; Shuji Kida; Yutaka Kaneko, all of Hino, Japan

[73] Assignee: Konica Corporation, Tokyo, Japan

[21] Appl. No.: 485,163

[22] Filed: Feb. 23, 1990

[30] Foreign Application Priority Data

Mar. 4, 1989 [JP] Japan ..... 1-52268

[51] Int. Cl.[5] ..... G03C 7/36

[52] U.S. Cl. ..... 430/543; 430/556; 430/557; 430/558

[58] Field of Search ..... 430/543, 556, 557, 558, 430/384, 385, 548

[56] References Cited

U.S. PATENT DOCUMENTS 3,502,468 3/1970 Rogers ..... 430/556

4,871,652 10/1989 Normandin ..... 430/557

OTHER PUBLICATIONS

*Journal of Organic Chemistry*, vol. 31, p. 919, (1966).

Patents Abstracts of Japan, vol. 13, No. 15 (C-559) (3363), Jan. 13, 1989; and JP-A-63 223 068, (K. Yoshida), Sep. 16, 1988.

Journal of the Chemical Society, Perkin Transactions I, No. 8, Aug. 1988, pp. 2439-2442, London, GB; Y. Kubo et al.: "Novel Syntheses of Naphthoquinone Methide Near-Infrared Dyes", (whole document).

*Primary Examiner*—Richard L. Schilling

*Attorney, Agent, or Firm*—Frishauf, Holtz, Goodman & Woodward

[57] ABSTRACT

A cyan coupler for color photographic use and, particularly, to a photographic coupler forming a dye image excellent in durability against heat, humidity and light is disclosed. A silver halide emulsion layer contains a compound represented by general formula 1, wherein R represents substituents; m represents an integer of 0 or 1 to 6, when m is 2 to 6, plurality of Rs are identical or different; Y and Z are substituents having a Hammett's substituent constant $\sigma p$ 0.3 to 1.5 and are identical or different; X represents a hydrogen atom or a substituent which is released by a reaction of an oxidized product of a color developing agent.

1 Claim, No Drawings

SILVER HALIDE PHOTOGRAPHIC MATERIAL

FIELD OF THE INVENTION

The present invention relates to a newly-developed coupler for color photographic use and, particularly, to a photographic coupler forming a dye image excellent in durability against heat, humidity and light.

BACKGROUND OF THE INVENTION

After exposing a silver halide photographic light-sensitive material to light, by color-developing it, an oxidized aromatic primary amine color developing agent and a dye-forming coupler react together to produce a dye, and a color image is then formed, in the exposed areas.

Generally, in this photographic method, a color reproducing method in a subtractive color system is used to form yellow, magenta and cyan color images.

As a photographic coupler used for forming the above-mentioned yellow color image, an acyl acetoanilide type coupler is used. As the couplers for forming magenta color images, a pyrazolone type coupler, a pyrazolobenzimidazole type coupler, a pyrazolotriazole type coupler and an indazolone type coupler are known. As the couplers for forming cyan color images, a phenol type coupler and a naphthol type coupler are used generally.

It is requested that such dye images obtained like this should neither be faded nor discolored, even after being exposed to light for a long time or being preserved under a high temperature and high humidity condition.

However, the phenol type coupler and naphthol type coupler that have been studied as the couplers for forming cyan dyes are still not satisfactory in spectral absorption characteristics, heat resistance, humidity resistance and light fastness of the cyan dye images to be formed. For the improvements of these points, various proposals have been done, such as a device for substituent groups. But, compounds satisfying all of them have not been obtained yet.

Therefore, with regard to the above-mentioned points, after the present inventors continued to study to discover photographic couplers for forming cyan dye images which are not changed in hue by heat, humidity and light, they accomplished the present invention.

SUMMARY OF THE INVENTION

It is an object of the present invention to provide a new photographic coupler as a raw material for color photographic use.

Another object of the present invention to provide a new photographic coupler for forming a cyan dye image which is not changed in hue by heat, humidity and light.

The above-mentioned objects of the present invention were accomplished by a photographic coupler given by the following formula I.

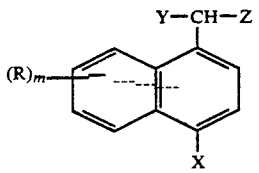

Formula I

Wherein R represents a substituent. m represents an integral number of 0 or 1 to 6. When m is 2 to 6, plural Rs may be the same or different. Y and Z are each a substituent having a Hamett substituent constant $\sigma p$ of between not less than 0.3 and not more than 1.5. It is allowed that Y and Z may be the same or different. X represents a hydrogen atom or a substituent which releases by a reaction with the oxidized product of a color developing agent.

DETAILED DESCRIPTION OF THE INVENTION

Hereunder, the present invention will be explained more particularly.

There is no special limitation with the substituents represented by R in Formula I, but they typically include an alkyl group, an aryl group, an anilino group, an acylamino group, a sulfonamido group, an alkylthio group, an arylthio group, an alkenyl group and a cycloalkyl group. Other than them, a halogen atom, a cycloalkenyl group, an alkinyl group, a heterocyclic group, a sulfonyl group, a sulfinyl group, a phosphonyl group, an acyl group, a carbamoyl group, a sulfamoyl group, a cyano group, an alkoxy group, a sulfonyloxy group, an aryloxy group, a heterocyclic oxy group, a siloxy group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group, a heterocyclic thio group, a thioureido group, a carboxyl group, a hydroxy group, a mercapto group, a nitro group, a sulfonic acid group, a spiro compound residual group and a bridged hydrocarbon compound residual group are also cited.

Among the substituents represented by R, as the alkyl groups, those having 1 to 32 carbons are preferable. They may have a straight chain or branched chain.

As the aryl groups, a phenyl group is preferable.

As the acylamino groups, alkylcarbonylamino group and arylcarbonylamino group are cited.

As the sulfonamido groups, an alkylsulfonylamino group and an arylsulfonylamino group are cited.

As the alkyl components in the alkylthio group and the aryl components in the arylthio group, the above-mentioned alkyl groups and the aryl groups are cited.

As the alkenyl groups, those having 2 to 32 carbons are preferable, and as the cycloalkyl group, those having 3 to 12 carbons particularly, 5 to 7 carbons are preferable. Alkenyl groups can have a straight chain or a branched chain.

As the cycloalkenyl groups, those having 3 to 12 carbons, particularly 5 to 7 carbons are preferable.

As the sulfonyl groups, an alkylsulfonyl group and an arylsulfonyl group;

As the sulfinyl groups, an alkylsulfinyl group and an arylsulfinyl group;

As the phosphonyl groups, an alkylphosphonyl group, an alkoxyphosphonyl group, an aryloxyphosphonyl group and an arylphosphonyl group;

As the acyl groups, an alkylcarbonyl group and an arylcarbonyl group;

As the carbamoyl groups, an alkylcarbamoyl group and an arylcarbamoyl group;

As the sulfamoyl groups, an alkylsulfamoyl group and an arylsulfamoyl group;

As the acyloxy groups, an alkylcarbonyloxy group and an arylcarbonyloxy group;

As the carbamoyloxy groups, an alkylcarbamoyloxy group and an arylcarbamoyloxy group;

As the ureido groups, an alkylureido group and an arylureido group;

As the sulfamoylamino groups, an alkylsulfamoylamino group and an arylsulfamoylamino group;

As the heterocyclic groups, those having 5 to 7 members are preferable. Substantially, a 2-furyl group, a 2-thienyl group, a 2-pyrimidinyl group, a 2-benzothiazolyl group, a 1-pyrrolyl group and a 1-tetrazolyl group;

As the heterocyclic oxy groups, those having a 5 to 7 members of heterocyclic ring are preferable, for example, a 3, 4, 5, 6-tetrahydropyranyl-2-oxy group and a 1-phenyltetrazole-5-oxy group;

As the heterocyclic thio groups, those having a 5 to 7 members are preferable, for example, a 2-pyridylthio group, a 2-benzothiazolylthio group and a 2, 4-diphenoxy-1, 3, 5-triazole-6-thio group;

As the siloxy groups, a trimethylsiloxy group, a triethylsiloxy group and a dimethylbutylsiloxy group;

As the imide groups, a succinimido group, a 3-heptadecyl succinimide group, a phthalimido group and a glutarimido group;

As the spiro compound residual groups, a spiro [3.3] heptane-1-yl;

As the bridged hydrocarbon compound residual groups, a bicyclo [2.2.1]heptane-1-yl, a tricyclo [3.3.1.1$^{3,7}$]decane-1-yl, and a 7, 7-dimethyl-bicyclo[2.2.1]heptane-1-yl are cited.

R is, preferably, among the above-mentioned substituents, an alkyl group, an aryl group, a carboxyl group, an oxycarboxyl group, a cyano group, a hydroxy group, an alkoxy group, an aryloxy group, an amino group, an amido group, a sulfonamido group and a halogen atom.

m represents 0 or 1 to 6 of an integral number. When m is 2 to 6, plural Rs may be the same or different.

Plural Rs may form a ring by binding to each other. The ring is preferable to be a saturated or unsaturated ring having 5 to 8 members. Substantially, a pyridine ring and a quinoline ring are cited.

The above-mentioned groups can have a substituent such as a ballast group, e.g., a long chained hydrocarbon group and a polymer residual group additionally.

In Formula I, as the substituents represented by Y and Z, such substituents having a Hamett substituent constant $\sigma p$ of between not less than 0.3 and not more than 1.5 are cited, such as a cyano group, a nitro group, a sulfonyl group (for example, an octylsulfonyl group, a phenylsulfonyl group, a trifluoromethylsulfonyl group and a pentafluorophenylsulfonyl group), a $\beta$-carboxyvinyl group, a sulfinyl group (for example, a t-butylsulfinyl group, a tolylsulfinyl group, trifluoromethylsulfinyl group, a pentafluorophenylsulfinyl group), a $\beta,\beta$-dicyanovinyl group, a halogenated alkyl group (for example, a trifluoromethyl group, a perfluorooctyl group and a $\omega$-hydroperfluorododecyl group), a formyl group, a carboxyl group, a carbonyl group (for example, an acetyl group, a pivaloyl group, a benzoyl group and a trifluoroacetyl group), an alkyloxycarbonyl group and an aryloxycarbonyl group (for example, an ethoxycarbonyl group and a phenoxycarbonyl group), a 1-tetrazoylyl group, a 5-chloro-1-tetrazolyl group, a carbamoyl group (for example, a dodecylcarbamoyl group and a phenylcarbamoyl group) and a sulfamoyl group (for example, a trifluoromethylsulfamoyl group, a phenylsulfamoyl group and an ethylsulfamoyl group) are cited.

Among such substituents, the preferable are a cyano group, a sulfonyl group and a sulfamoyl group.

Regarding the Hammett substituent $\sigma p$, if it is less than 0.3, the cyan coupler of this invention which is to form a cyan dye, becomes colorless, and if it is more than 1.5, it is almost impossible to synthesize.

As the groups represented by X which can release by reaction with the oxidized product of a color developing agent, a hydrogen atom, a halogen atom (such as a chlorine atom, a bromine atom and a fluorine atom), an alkoxy group, an aryl oxy group, a heterocyclic oxy group, an acyloxy group, a sulfonyloxy group, an alkoxycarbonyloxy group, an aryloxycarbonyl group, an alkyloxalyloxy, an alkoxyoxalyloxy, an alkylthio group, an arylthio group, a heterocyclic thio group, an alkyloxythiocarbonylthio group, an acylamino group, a sulfonamido group, a nitrogen-containing heterocyclic group coupled to the position of the nitrogen atom, an alkyloxycarbonylamino group, an aryloxycarbonyamino group and a carboxyl group are cited. The preferable is a halogen atom or a hydrogen atom. Among them, the particularly preferable represented by X are a hydrogen atom and a chlorine atom.

Hereunder, some typical examples of the compounds used in the present invention will be exemplified.

| HAMMETT Substituent Constant at para position | |
|---|---|
| —CN | 0.66 |
| —$CONH_2$ | 0.36 |
| —CONH—$CH_3$ | 0.36 |
| —$SO_2CF_3$ | 0.93 |
| —$SO_2CH_3$ | 0.72 |
| —$SO_2$— 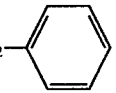 | 0.70 |
| —$SO_2NH_2$ | 0.57 |
| —H | 0.00 |
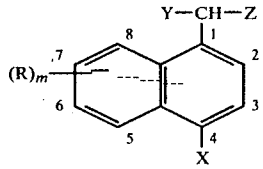
| No. | R | m | Y | Z | X |
|---|---|---|---|---|---|
| 1 | — | 0 | σp: 0.66 —CN | —CN | —H |
| 2 | — | 0 | —CN | —CN | —Cl |
| 3 | —CONH— 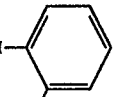 (2) $OC_{14}H_{29}$ | 1 | —CN | —CN | —H |
| 4 | —CONH— 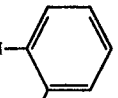 (2) $OC_{16}H_{33}$(sec) | 1 | —CN | —CN | —Cl |
| 5 | $C_5H_{11}$(t) —CONH$(CH_2)_4$O— 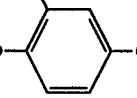 —$C_5H_{11}$(t) (2) | 1 | —CN | —CN | —O— 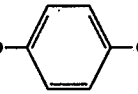 —$COOCH_3$ |

-continued
| | | | | | |
|---|---|---|---|---|---|
| 6 | $-NHCOC_{14}H_{29}$ (5) | 1 | $-CN$ | $-CN$ | $-SCH_2CH_2COOH$ |
| 7 | 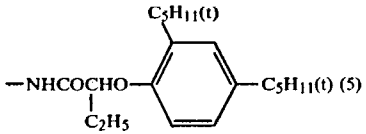 | 1 | $-CN$ | $-CN$ | $-H$ |
| 8 | 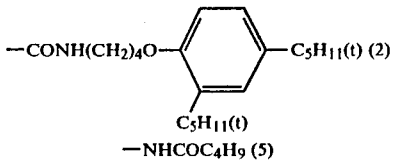 | 2 | $-CN$ | $-CN$ | $-Cl$ |
| 9 | $-CONHC_{16}H_{33}$ (sec) (2)<br>$-NHSO_2CH_3$ (5) | 2 | $-CN$ | $-CN$ | $-OCH_2CH_2OH$ |
| 10 | 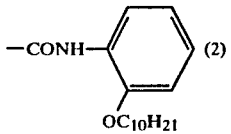 | 2 | $-CN$ | $-CN$ | 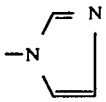 |
| 11 | $-CONHC_{16}H_{33}$ (sec) (2) | 1 | $-CN$ | $-CN$ | 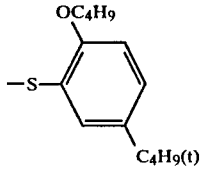 |
| 12 | — | 0 | $-CN$ | σp: 0.36<br>$-CONH_2$ | $-H$ |
| 13 | 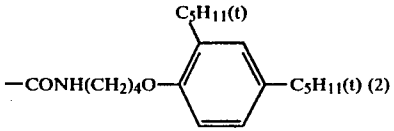 | 1 | $-CN$ | $-CONH_2$ | $-H$ |
σp: 0.36

-continued
| | | | | | |
|---|---|---|---|---|---|
| 14 | 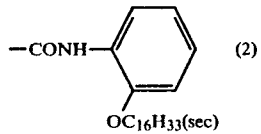 (2) | 1 | —CN | —CONH—$CH_3$ | —Cl |
| 15 | —$NHCOC_{14}H_{29}$ (5) | 1 | —CN | —$CONH_2$ | —Cl |
| 16 | —$NHCONHC_6H_{13}$ (5) | 1 | —CN | —$CONH_2$ | —$SCH_2CH_2OH$ |
| 17 | —Cl (2) | 1 | —CN | σp: 0.93<br>—$SO_2CF_3$ | —Cl |
| 18 | —$CONHC_{10}H_{21}$ (2) | 1 | —CN | —$SO_2C_4H_9$ | —H |
| 19 | —$NHCOC_{16}H_{33}$ (5) | 1 | —CN | σp: 0.72<br>—$SO_2CH_3$<br>σp: 0.70 | —Cl |
| 20 | 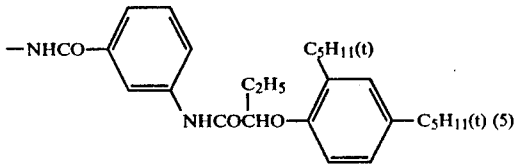 | 1 | —CN | 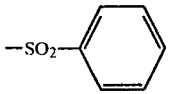 | —Cl |
| 21 | 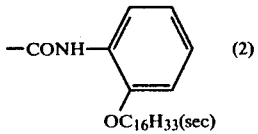 (2)<br>—$NHCOCF_3$ (5) | 2 | —CN | —$SO_2C_2H_5$ | 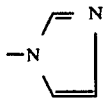 |
| 22 | 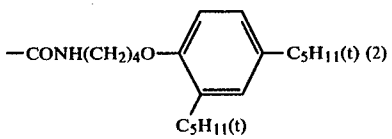 —$C_5H_{11}$(t) (2)<br>—$NHCONHC_4H_9$ (5) | 2 | —CN | —$SO_2C_2H_5$ | —$OCH_2COOH$ |
| 23 | —$NHCOC_{16}H_{33}$ (5) | 1 | —CN | —$SO_2NHCH_3$ | —H |
| 24 | — | 0 | —$SO_2CF_3$ | —$SO_2CF_3$ | —H |
| 25 | —$CONHC_{12}H_{25}$ (2) | 1 | σp: 0.57<br>—$SO_2NH_2$ | —$SO_2C_4H_9$ | —Cl |

-continued
| | | | | | |
|---|---|---|---|---|---|
| 26 | 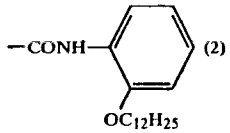 (2) | 1 | $-SO_2NH_2$ | $-CONH_2$ | $-H$ |
| 27 | $-NHCOC_{14}H_{29}$ (5)<br>$-CONHC_8H_{17}$ (2) | 1 | $-SO_2C_2H_5$ | $-SO_2NHCH_3$ | $-H$ |
| 28 | $-NHCOC_{10}H_{21}$ (5) | 2 | 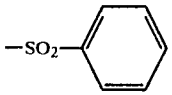 | $-SO_2NHCH_3$ | $-H$ |
| 29 | 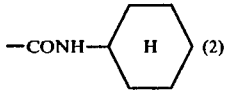 (2) | 1 | $-SO_2NH_2$ | 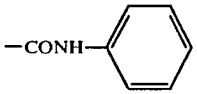 | $-Cl$ |

The above-mentioned compounds of the present invention can be synthesized according to the synthesizing method described in Journal of Organic Chemistry, Volume 31, page 919, 1966.

Hereunder, the synthesizing method of the compounds of the present invention is shown substantially.

Synthesizing method of the exemplified compound 1

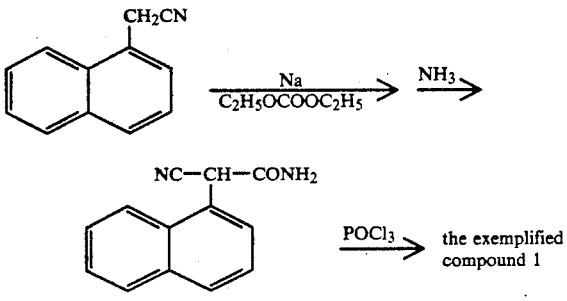

intermediate a

Synthesizing of intermediate a 1-naphthylacetonitrile of 30 g and 4.1 g of metal sodium are dissolved into 890 ml of diethyl carbonate, and heated and agitated for 4 hours at a temperature of 100°~110° C. After this solution is cooled down to room temperature, it was acidified with acetic acid. Then, water was added and it was extracted with benzene. After benzene was distilled off, 720 ml of concentrated aqueous ammonia was added to the residual orange-colored oil material. It was agitated for 16 hours in room temperature to obtain a milky white color precipitate. It was filtrated and collected. By recrystallizing with ethanol, 21.0 g of intermediate a having light-orange-colored crystals was obtained. (m.p. 189°~192° C.)

The structure was confirmed by $^1$HNMR, IR, FD mass spectrum.

Synthesizing of exemplified compound 1

Intermediate a of 21 g, 8.6 ml of phosphorous oxychloride and 15.3 g of salt were dissolved into 100 ml of acetonitrile. It was heated and refluxed for 18 hours at 80°~85° C. The solution was filtrated while it was heated. When the filtrated solution was cooled down, orange-colored crystals were separated therefrom. They were filtrated and, when the filtrated solution was poured to 500 ml of water, brown precipitates were obtained. When the precipitates and the previously obtained crystals were mixed to be re-crystalized with ethanol, 16.1 g of the exemplified compound 1 having light-orange-colored crystals was obtained.(m.p. 166°~167° C.)

The structure was confirmed by $^1$HNMR, IR, FD mass spectrum.

The coupler of the present invention can be used ordinarily in the range of $1\times10^{-3}$ mols ~1 mol per mol of silver halide and, preferably in the range of $1\times10^{-2}$ mols ~ $8\times10^{-1}$ mols.

The coupler of the present invention can be used together with the other cyan couplers.

To the coupler of the present invention, any conventional methods and techniques have been used for dye-forming couplers may be applied similarly.

When the coupler of the present invention is used as a raw material for making color photographs in the coupler-in-emulsion type process, it is used in a photographic light-sensitive material.

Typically, the method, wherein the coupler of the present invention is compounded into a silver-halide emulsion and the emulsion is coated onto a support to prepare a color light-sensitive material, is preferably used. The coupler of the present invention is applied to color photographic light-sensitive materials such as a color negative film, a color positive film and a color paper.

Such light-sensitive materials using the coupler of the present invention, including color paper, can be monochromatic or multi-colored. In multi-color light-sensitive materials, the coupler of the present invention can be contained in any layers, and normally it is contained in a red sensitive silver halide emulsion layer. The multi-color light-sensitive materials contains dye image forming composition units sensitive to three spectral primary color areas, respectively. Each of the composition units can be comprised of a mono- or multi-layered emulsion layer that is sensitive to a certain spectral area. The component layers of the light-sensitive material, including the image-forming composition units, can be arranged in various order as known in the art. Typical multi-color light-sensitive material is composed of a support bearing thereon a red dye image-forming composition unit composed of at least one red sensitive silver halide emulsion layer containing at least one cyan coupler (at least one of the cyan couplers is that of the present invention), a magenta dye image-forming composition unit composed of at least one green sensitive silver halide emulsion layer containing at least one magenta coupler, and a yellow dye image-forming composition unit composed of at least one blue sensitive silver halide emulsion layer containing at least one yellow coupler.

The light-sensitive materials each can have additional layers, such as a filter layer, an intermediate layer, a protective layer and a subbing layer. For containing the coupler of the present invention in emulsions, any known conventional methods can be used.

The couplers of the present invention is dissolved singly or mixedly into a high boiling organic solvent such as tricrezylphosphate and dibuthylphthalate having a boiling point of not less than 175° C., into a low boiling solvent such as butyl acetate and butyl propionate singly, or, according to the necessity, into the mixture thereof. The solution is then mixed with an aqueous gelatin solution containing a surfactant. After it is emulsified with a high speed rotary mixer or a colloid mill, it is added to silver halide so that a silver halide emulsion applicable to the present invention can be prepared.

As a silver halide composition preferably used in the light-sensitive material using the coupler of the present invention, silver chloride, silver bromochloride or silver iodobromochloride are used. Furthermore, it is allowed to use a mixture of silver chloride and silver bromide can be used. To be concrete, when a silver halide emulsion is used for color paper, particularly a speedy developability is required, so that it is preferable to contain a chlorine atom as the halogen component of the silver halide and that it is particularly preferable to be silver chloride, silver bromochloride or silver iodobromochloride having at least a 1% silver chloride content.

The silver halide emulsions are chemically sensitized by a conventional method. Besides, they are optically sensitized to a desired wavelength region.

To a silver halide emulsion, such compounds as are known in the art as an anti foggant or a stabilizer are added during the preparing processes of a light-sensitive material, or the preservation or photographic treatment thereof, for the purposes of preventing fogging and/or keeping photographic property stable To a color light-sensitive material using the coupler of the present invention, an anti-color fogging agent a dye-image stabilizer, a UV absorbent, an anti static agent, a matting agent and a surfactant, used in a normal light-sensitive material, can be used.

For further details thereof, the descriptions in Research Disclosure Volume 176, page 22 to 31, Dec.1978 can be referred.

A color photographic light-sensitive material using the coupler of the present invention can form an image thereon by treating it in any color developing process known in the art.

The color photographic light-sensitive material using the coupler of the present invention can contain a color developing agent as it is or as its precursor in a hydrophilic colloidal layer and can be processed in an alkaline activating bath.

The color photographic material using the coupler of the present invention is subject to a bleaching and fixing processes after color-developing it. The bleaching process can be done simultaneously with the fixing process.

After the fixing process, normally, a washing process is done. In place of the washing process, a stabilizing process can be done and the both processes can be used in combination.

EXAMPLES

Then, the present invention is explained in detail, with reference to the following examples But it is not limited to them.

EXAMPLE 1

Onto a paper support whose both surfaces were laminated by polyethylene, the following layers were coated in order from the support's side in order to prepare a red sensitive color light-sensitive material Sample 1. Note that the added amounts of components are expressed in terms of those per 1 $m^2$, unless otherwise expressly pointed out. (The amount of silver halide is expressed by a value converted into silver content.)

The first layer: An emulsion layer

A red sensitive emulsion layer comprising 1.2 g of gelatin, 0.30 g of a red sensitive silver bromochloride emmulsion (having a 96 mol% silver chloride content) and $9.1\times10^{-4}$ mols of comparative cyan coupler a or c dissolved in 1.35 g of dioctylphosphate.

The second layer: A protective layer

A protective layer containing 0.50 g of gelatin. As a hardener, 0.017 g of sodium 2, 4-dichloro-6-hydroxy-s-triazine salt was added per 1 g of gelatin.

Then, Samples 2 to 8 were prepared in quite the same manner as in Sample 1, except that Comparative Coupler a or c was replaced by the couplers shown in Table-1 (added in the same amount as in Comparative coupler a or c).

Sample 9 was prepared in quite the same manner as in sample 1, except that the comparative coupler a was replaced by comparative coupler c.

After Samples 1 to 9 obtained as above were wedgewise exposed according to the conventional method, they were developed in the next processing step.

| Development processing step | | |
|---|---|---|
| Color developing | 38° C. | 3 min. and 30 sec. |
| Bleaching and fixing | 38° C. | 1 min. and 30 sec. |
| Stabilizing | 25° C.~30° C., | 3 min. |
| Drying | 75° C.~80° C., | 2 min. |

The compositions of the processing solutions used in the processing steps were as follows;

| (Color developer) | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N-ethyl-N-(β-methanesulfonamidoethyl)aniline sulfate | 5.5 g |
| Optical brightening agent (a 4, 4'-diaminostilbenedisulfonic acid derivative) | 1.0 g |
| Potassium hydroxide | 2.0 g |
| Add water to make 1 liter, and adjust pH to 10.20. | |

| Bleaching and fixing solution | |
|---|---|
| Ferrite ammonium ethylenediamine tetraacetate dihydrate | 60 g |
| Ethylenediamin tetraacetic acid | 3 g |
| Ammonium thiosulfate (in a 70% solution) | 100 ml |
| Ammonium disulfate (in a 40% solution) | 27.5 ml |

Adjust pH to 7.1 with potassium carbonate or glacial acetic acid, then, add water to make 1 liter in total.

Stabilizer

| | |
|---|---|
| 5-chloro-2-methyl-4-isothiazoline-3-one | 1.0 g |
| Ethylene glycol | 10 g |
| Add water to make 1 liter. | |

With regard to Samples 1 to 9 processed as above, their densities were measured, using a densitometer (Model KD-7 manufactured by KONICA CORPORATION). Further, the above-mentioned processed samples were left for 14 days under the conditions of a high temperature and a high humidity (60° C., 80%RH), and the heat and humidity resistance of the resulting dye images were checked up.

Besides, after the samples were exposed to a Xenon fade meter for 10 days, the densities were measured and the light fastness were checked up. The results are shown in Table-1. Note that the heat atability and moisture resistance and the light fastness are indicated in terms of the dye residual percentage obtained after the test for heat and moisture resistance and light fastness at the initial density 1.0.

TABLE 1

Comparative coupler a

TABLE 1-continued

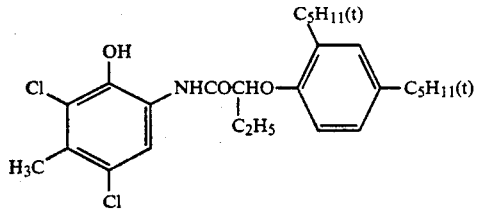

Comparative coupler c

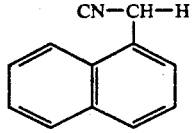

CN—CH—H Hammett σp
CN . . . 0.66
H . . . 0.00

| Sample No. | Coupler used | Dye residual percentage (%) Heat and moisture resistance | Light fastness |
|---|---|---|---|
| 1 | Comparative a | 64 | 82 |
| 2 | Invention 1 | 91 | 84 |
| 3 | Invention 3 | 91 | 82 |
| 4 | Invention 6 | 92 | 85 |
| 5 | Invention 8 | 89 | 83 |
| 6 | Invention 14 | 91 | 82 |
| 7 | Invention 17 | 87 | 86 |
| 8 | Invention 25 | 89 | 83 |
| 9 | Comparative C | color not formed | |

As is clear from the results shown in Table-1, it is found that the every Sample used therein the coupler of the present invention is higher in the dye residual percentage, excellent in heat and moisture resistance and in light fastness and more rigid than those of Comparative couplers.

EXAMPLE 2

Onto a subbed triazetate film, the following layers were coated in order from the support's side to prepare a red sensitive color light-sensitive material, Sample 9. Note that the added amounts of compounds are expressed in terms of those per 1 $m^2$, unless otherwise expressly pointed out. (The amount of silver halide is expressed by a value converted into silver content.)

The first layer: An emulsion layer

A red sensitive emulsion layer comprising 1.4 g of gelatin, 1.5 g of a red sensitive silver iodobromide emmulsion (having a 4 mol% silver iodide content), and $8.0\times10^{-4}$ mols of comparative cyan coupler b dissolved in 1.1 g of tricresylphosphate.

The second layer: A protective layer

A protective layer containing 1.5 g of gelatin. As a hardener, 0.017 g of sodium 2, 4-dichloro-6-hydroxy-s-triazine salt was added per 1 g of gelatin.

Then, Samples 11 to 17 were prepared in quite the same manner as in Sample 10, except that Comparative Coupler b was replaced by the couplers shown in Table-2 (added in the same amount as in Comparative Coupler b).

After Samples 10 to 17 obtained as above were wedgewise exposed according to the conventional method, they were color-developed in the next processing step.

Comparative Coupler b

-continued

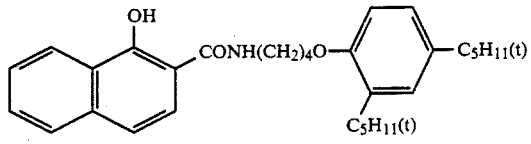

| Development processing step | | |
|---|---|---|
| Color developing | 38° C. | 3 min. 15 sec. |
| Bleaching | 38° C. | 6 min. 30 sec. |
| Washing | 25° C.~30° C. | 3 min. 15 sec. |
| Fixing | 38° C. | 6 min. 30 sec |
| Washing | 25° C.~30° C. | 3 min. 15 sec. |
| Stabilizing | 25° C.~30° C. | 1 min. 30 sec. |
| Drying | 75° C.~80° C. | |

The compositions of the processing solutions used in the processing steps were as follows:

| Color developer | |
|---|---|
| 4-amino-3-methyl-N-ethyl-N-(β-hydroxyethyl) aniline sulfate | 4.75 g |
| Sodium sulfate anhydride | 4.25 g |
| Hydroxyamine ½ sulfate | 2.0 g |
| Potassium carbonate anhydride | 37.5 g |
| Sodium bromide | 1.3 g |
| Trisodium nitrilotriacetate (monohydride) | 2.5 g |
| Potassium hydroxide | 1.0 g |
| Add water to make 1 liter, then, adjust pH to 10.6 with Sodium hydroxide. | |

| Bleaching solution | |
|---|---|
| Iron ammonium ethylenediaminetetraacetate | 100 g |
| Diammonium ethylenediamine tetraacetate | 10.0 g |
| Ammonium bromide | 150 g |
| Glacial acetic acid | 10.0 g |

Add water to make 1 liter, then adjust pH to 6.0 with aqueous ammonia.

| Fixer | |
|---|---|
| Ammonium thiosulfate | 175.0 g |
| Sodium sulfite anhydride | 8.6 g |
| Sodium methasulfite | 2.3 g |
| Add water to make 1 liter, then adjust pH to 6.0 with acetic acid. | |

| Stabilizer | |
|---|---|
| Formalin (37 weight %) | 1.5 ml |
| Konidax (manufactured by KONICA CORPORATION) | 7.5 ml |
| Add water to make 1 liter. | |

With regard to Samples 10 to 17 processed as above, their densities were measured, using a densitometer (Model KD-7 manufactured by KONICA CORPORATION). Further, the above-mentioned processed samples were left for 14 days under the conditions of a high temperature and a high humidity (60° C., 80%RH), and the heat and humidity resistance of the resulting dye images were checked up.

Besides, after the samples were exposed to a Xenon fade meter for 10 days, the light fastness was checked up. The results are shown in Table-2. Note that the heat and moisture resistance and the light fastness are indicated in terms of the dye residual percentage obtained after the test for heat and moisture resistance and light fastness at the initial density of 1.0.

TABLE 2

| Sample No. | Coupler used | Dye residual percentage (%) Heat and moisture resistance | Light fastness |
|---|---|---|---|
| 10 | Comparative b | 72 | 80 |
| 11 | Invention 2 | 85 | 83 |
| 12 | Invention 4 | 89 | 83 |
| 13 | Invention 5 | 87 | 83 |
| 14 | Invention 9 | 85 | 85 |
| 15 | Invention 13 | 88 | 84 |
| 16 | Invention 16 | 85 | 87 |
| 17 | Invention 24 | 86 | 82 |

As is clear from the results shown in Table-2, it is found that the every Sample used therein the coupler of the present invention is higher in the dye residual percentage, excellent in heat and moisture resistance and in light fastness and more rigid than those of Comparative couplers.

EXAMPLE 3

Onto a triacetyl cellulose film, the following layers were coated in order from the support's side to prepare a red sensitivity color reversal photographic light-sensitive materials, Sample 18 to 23, respectively, containing the couplers shown in Table-3.

The first layer: An emulsion layer

A red sensitivity emulsion layer comprising 1.4 g of gelatin, 0.5 g of a red sensitive silver bromochloride emmulsion (having a 96 mol% silver chloride content) and $9.1\times 10^{-4}$ mols of the coupler shown in Table-3 dissolved in 1.5 g of dibutyl phthalate.

The second layer: A protective layer

A protective layer containing 0.5 g of gelatin. As a hardener, 0.017 g of sodium 2, 4-dichloro-6-hydroxy-s-triazine salt was added per 1 g of gelatin.

After the Samples obtained as above were wedgewise exposed according to the conventional method, they were color-developed in the next step.

| Reversal processing step Step | Time | Temperature |
|---|---|---|
| Primary developing | 6 minutes | 38° C. |
| Washing | 2 minutes | 38° C. |
| Reversing | 2 minutes | 38° C. |
| Color developing | 6 minutes | 38° C. |
| Adjusting | 2 minutes | 38° C. |
| Bleaching | 6 minutes | 38° C. |
| Fixing | 4 minutes | 38° C. |
| Washing | 4 minutes | 38° C. |
| Stabilizing | 1 minute | 38° C. |
| Drying | | Normal temperature |

The compositions of the processing solutions were as follows:

| | |
|---|---|
| Primary developer | |
| Sodium tetrapolyphosphate | 2 g |
| Sodium sulfite | 20 g |
| Hydroquinone monosulfonate | 30 g |
| Sodium carbonate (monohydrate) | 30 g |
| 1-phenyl-4-methyl-4-hydroxymethyl-3-pyrazolidone | 2 g |

-continued

| | |
|---|---|
| Potassium bromide | 2.5 g |
| Potassium thiocyanate | 1.2 g |
| Potassium iodide (in a 0.1% solution) | 2 ml |
| Add water to make 1000 ml. | |
| Reversal solution | |
| Hexasodium nitrilotrimethylenephosphonate | 3 g |
| Stannous chloride (dihydrate) | 1 g |
| p-aminophenol | 0.1 g |
| Sodium hydroxide | 5 g |
| Glacial acetic acid | 15 ml |
| Add water to make 1000 ml. | |
| Color developer | |
| Sodium tetrapolyphosphate | 2 g |
| Sodium sulfite | 7 g |
| Sodium tertiary phophate (dodecahydrate) | 36 g |
| Potassium bromide | 1 g |
| Potassium iodide (in a 0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |
| Ethylenediamine | 3 g |
| Add water to make 1000 ml. | |

| | |
|---|---|
| Adjusting solution | |
| Sodium sulfite | 12 g |
| Sodium ethylenediaminetetraacetate (dihydrate) | 8 g |
| Thioglycerol | 0.4 ml |
| Glacial acetic acid | 3 ml |
| Add water to make 1000 ml. | |
| Bleacher | |
| Sodium ethylenediamine tetraacetate (dihydrate) | 2.0 g |
| Iron (III) ammonium ethylenediamine tetraacetate (dihydrate) | 120.0 g |
| Potassium bromide | 100.0 g |
| Add water to make 1000 ml. | |
| Fixer | |
| Ammonium thio sulfate | 80.0 g |
| Sodium sulfite | 5.0 g |
| Sodium bisulfite | 5.0 g |
| Add water to make 1000 ml. | |
| Stabilizer | |
| Formalin (37 weight %) | 5.0 ml |
| Konidax (manufactured by KONICA CORPORATION) | 5.0 ml |
| Add water to make 1000 ml. | |

With regard to the samples processed as above, the heat and moisture resistance and light fastness were checked up in the same manner as in Example 2. The result is shown in Table-3.

TABLE 3

| Sample No. | Coupler used | Dye residual percentage (%) Heat and moisture resistance | Light fastness |
|---|---|---|---|
| 18 | Comparative a | 62 | 82 |
| 19 | Invention 1 | 90 | 82 |
| 20 | Invention 11 | 92 | 84 |
| 21 | Invention 15 | 87 | 79 |
| 22 | Invention 19 | 92 | 82 |
| 23 | Invention 29 | 91 | 83 |

As is clear from the results shown in Table-3, it is found that the every Sample used therein the coupler of the present invention is higher in the dye residual percentage, excellent in heat and moisture resistance and in light fastness and more rigid than those of Comparative couplers.

EXAMPLE 4

With the following layer composition, multi layered color film, Sample 24, was prepared by coating an anti halation layer on a support.

Layer composition—Protective layer, BH layer, BL layer, YF layer, GH layer, GL layer, IL layer, RH layer, RL layer and support.

Then, with regard to RL layer, RH layer, GL layer, GH layer, BL layer, BH layer, IL layer, YF layer and Protective layer, the explanations will be given.

RL layer : A low-speed red-sensitivity silver halide emulsion layer

This layer contained 1.0 g of an emulsion which was a red-sensitized Emulsion I comprising AgBrI having an average grain-size $\bar{r}$ of 0.47 μm , a variation coefficient $s/\bar{r}$ of 0.12 and an average AgI content of 8 mol%; 1.0 g of Emulsion II comprising AgBrI having an average grain-size of 0.31 μm, a variation coefficient of 0.10 and an average AgI content of 8 mol %; 0.07 g of CC-A, i.e., disodium 1-hydroxy-4-[4-(1-hydroxy-8-acetoamido-3, 6-disulfo-2-naphthylazo)-phenoxy]-N-[δ-(2, 4-di-t-amyl phenoxy)butyl]-2-naphthoamide, 0.4 g of C-A, i.e., 1-hydroxy-2-[δ-(2, 4-di-t-amylphenoxy)-n-butyl]naphthoamide; and a dispersed matter wherein 0.06 g of a DIR compound D-1, was dissolved in 1.0 g of tricresylphosphate (TCP), and it was dispersed to be emulsified into an aqueous-solution containing 2.4 g of gelatin.

RH layer : A high speed red-sensitivity silver halide emulsion layer

This layer contained 2.0 g of an emulsion which was a red-sensitized Emulsion (III) which is comprising AgBrI having an average grain-size 0.7 μm, a variation coefficient of 0.12 and an average AgI content of 6 mol %; and a dispersed matter wherein, C-A, 0.20 g of cyan coupler and, CC-A, 0.03 g of colored cyan coupler are dissolved into 0.23 g of TCP and it was dispersed emulsifingly into an aqueous solution containing 1.2 g of gelatin.

GL layer :(A low speed green-sensitive silver halide emulsion layer

This layer contained 1.5 g of an emulsion I which was gree-sensitized, 1.5 g of emulsion II which was green sensitized and a dispersed matter wherein 0.68 g of TCP in which 0.35 g of 1-(2, 4, 6-trichlorophenyl)-3-[3-(p-dodecyloxybenzenesulfonamido)benzamido]-5-pyrazolone (M-A), 0.10 g of 1-(2, 4, 6-trichlorophenyl)-4-(1-naphthylazo)-3-(2-chloro-5-octadecenylsuccinimidoanilino)-5-pyrazolone (CM-A) and 0.04 g of a DIR compound (D-1) are dissolved dispersed to be emulsified into an aqueous-solution containing 2.4 g of gelatin.

GH layer : A high speed green-sensitive silver halide emulsion layer

A layer contained 2.0 g of Emulsion III which has been color sensitized to blue and a dispersed matter wherein 0.27 g of TCP in which 0.14 g of magenta coupler (M-A) and 0.045 g of colored magenta coupler (CM-A) dissolved dispersed to be emulsified into an aqueous-solution containing 2.4 g of gelatin.

BL layer : A low speed blue-sensitive silver halide emulsion layer

A layer contained 0.5 g of Emulsion I which has been color-sensitized to blue, 0.5 g of Emulsion II which has been color-sensitized to blue and a dispersed matter wherein 0.68 g of TCP in which 0.7 g of α-pyvaloyl-α-(1-benzzyl-2-phenyl-3, 5-dioxyimidazolizine-4-yl)-2-chloro-5-[α-dodecyloxycarbonyl)ethoxycarbonyl-]acetoanilide (Y-A) and 0.02 g of DIR compound (D-1) dissolved dispersed to be emulsifiedly into an aqueous-solution containing 1.8 g of gelatin.

BH layer : A high speed blue-sensitive silver halide emulsion layer

A layer contained 0.9 g of an emulsion which contains AgBrI whose average grain size 0.80 μm having variation coefficient 0.14 and containing average 6 mol % of AgI and which is color-sensitized to blue and a dispersed matter wherein 0.25 g of TCP in which 0.25 g of yellow coupler (Y-A) dissolved is dispersed to be emulsified into an aqueous-solution containing 2.0 g of gelatin.

IL layer : Intermediate layer

A layer contained 0.07 g of dibutyl phthalate (DBP) wherein 0.07 g of 2, 5-di-t-octylhydroquinone (HQ-1) dissolved.

YF layer : Yellow filter layer

A layer contained 0.15 g of yellow colloidal silver, 0.11 g of DBP wherein 0.2 g of HQ-1 (color stain preventing agent) dissolved and 10 g of gelatin.

Pro layer Protective layer

A layer composed of 2.3 g of gelatin.

Sample 24 was manufactured as mentioned above. And Samples 25 through 34 were manufactured just same as Sample 24, except that a low speed and high speed red sensitive silver halide emulsion layers replaced by the same mol of the coupler in the present invention given in Table-4.

Samples 24 through 34 manufactured like this wedgewise exposured white light. Then, they were processed similarly as the above-mentioned Example 2. And the coloring density of Samples after development process was measured with a red filter, and photographic data were obtained.

DIR compound

D-1

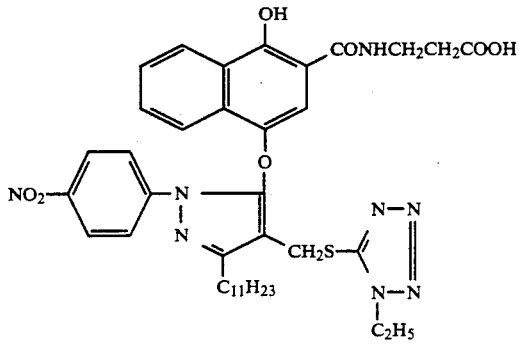

TABLE 4

| Sample No. | Cyan coupler in the red sensitivity layer | | Fog (D-min) | Relative sensitivity |
|---|---|---|---|---|
| 24 | C-A | Comparative | 0.10 | 100 |
| 25 | 1 | Invention | 0.08 | 120 |
| 26 | 3 | Invention | 0.11 | 128 |
| 27 | 4 | Invention | 0.09 | 127 |
| 28 | 6 | Invention | 0.09 | 125 |
| 29 | 9 | Invention | 0.09 | 122 |
| 30 | 13 | Invention | 0.11 | 119 |
| 31 | 17 | Invention | 0.10 | 118 |
| 32 | 20 | Invention | 0.08 | 115 |
| 33 | 22 | Invention | 0.11 | 120 |
| 34 | 27 | Invention | 0.10 | 118 |

As shown in Table-4, Samples 25 through 34 that used the coupler in the present invention were extremely higher in relative sensitivity and the same in fogging compared with Sample 24 conventional cyan coupler is used.

What is claimed is:

1. A silver halide photographic material comprising a support and provided thereon at least one layer containing silver halide grains, which material comprises a compound represented by

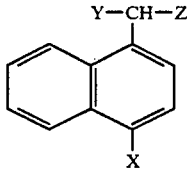

Y is CN, Z is CN and X is hydrogen.

* * * * *